United States Patent [19]

Folk

[11] Patent Number: 4,967,470

[45] Date of Patent: Nov. 6, 1990

[54] ALIGNMENT APPARATUS FOR POSITIONING A CONNECTOR HOUSING DURING WIRE INSERTION

[75] Inventor: Kenneth F. Folk, Harrisburg, Pa.

[73] Assignee: AMP Incorporated, Harrisburgh, Pa.

[21] Appl. No.: 511,116

[22] Filed: Apr. 20, 1990

[51] Int. Cl.[5] ..... H01R 43/00

[52] U.S. Cl. ..... 29/747; 29/748; 29/759

[58] Field of Search ..... 29/747, 748, 759, 754, 29/755

[56] References Cited

U.S. PATENT DOCUMENTS 4,837,926 6/1989 Boutcher, Jr. ..... 29/747

*Primary Examiner*—Carl E. Hall

*Attorney, Agent, or Firm*—James M. Trygg

[57] ABSTRACT

Apparatus for accurately aligning a cavity in a plastic connector housing for insertion of an electrical terminal and attached wire during a block loading operation. The apparatus includes a two part terminal guiding member having a funnel shaped hole through which the terminal and wire are passed. Features are included that engage the connector housing moving in until a selected cavity is in alignment with the funnel shaped hole which has the same shape as the cavity and is the same size or slightly smaller. The terminal and wire are then inserted into the selected cavity and the two part guiding member opened and withdrawn.

10 Claims, 8 Drawing Sheets

76
76'

160
162
164
166
168
170
96

40
76'
5
74
8
8
96
164
162
166
92'
90'
94
5

94

ALIGNMENT APPARATUS FOR POSITIONING A CONNECTOR HOUSING DURING WIRE INSERTION

The present invention relates to apparatus of the type commonly known as "block loaders", for inserting terminals on the ends of wires into cavities disposed in an electrical connector housing. Such apparatus is frequently utilized in conjunction with automated cable making machinery.

BACKGROUND OF THE INVENTION

During the manufacture of electrical cable assemblies and subassemblies, terminals crimped or otherwise terminated to the ends of wires are inserted into specially formed cavities disposed in a connector housing. These terminals generally have barbs or some other self locking or retaining tabs that interact with the walls of the cavity to retain the terminal therein. The connector housing may have a relatively large number of such cavities arranged in parallel rows, on closely spaced centers. The design of inserting machines of the present type present several wire and connector handling problems as a result of the need for very closely spaced terminals. It is difficult to design parts with adequate clearance to permit the insertion of terminals into cavities which have adjacent cavities that have already received terminals because of the presence of the wires extending from the previously inserted terminals. The alignment and guidance of the terminal during insertion into the cavity is a particularly difficult problem and is addressed by the present invention.

Modern apparatus for inserting terminals and associated wires into cavities in connector housings typically include a connector housing holder which accurately locates and positions the housing with respect to an insertion center line. Additionally included are a wire gripper which holds the wires and moves it axially into the cavity of the housing and a guide member which surrounds the guides movement of the terminal that is crimped on the end of the wire. Such a wire gripper and guide member are shown in U.S. Pat. No. 4,779,334, which issued Oct. 25, 1988 to Boutcher, Jr., and which is incorporated by reference as though set forth verbatim herein. The guide member of Boutcher very accurately positions the terminal on a known center line for insertion into the cavity. This, of course, requires that the cavity also be accurately positioned on the same center line prior to insertion. It is the usual practice to position the connector housing by means of an X-Y robotic table which can be computer controlled to move the housing very precisely in the X and Y directions to position the desired cavity in alignment with the insertion center line. This type of apparatus usually locates on external surfaces of the connector housing and assumes that the cavities are a known distance from these locating surfaces Such an apparatus is disclosed in U.S. Pat. No. 4,837,926 which issued June 13, 1989 to Boutcher, Jr., and which is incorporated by reference as though set forth verbatim herein. Connector housings having only two cavities each are shown in Boutcher, however, when a large number of cavities are present, the distances from the individual cavities to the locating surfaces vary due to manufacturing tolerance build-up. With a large number of very small, closely spaced cavities, the position of any cavity relative to the locating surfaces cannot be determined sufficiently accurately to assure adequate alignment during insertion of the terminal. The present invention overcomes this problem by means of a novel guide member and connector housing holder.

SUMMARY OF THE INVENTION

The present invention is an apparatus that accurately positions a cavity in a connector housing with respect to an electrical terminal and associated wire that is to be inserted into the cavity. This includes a block loader apparatus for an electrical cable making machine including a holder means for holding a connector housing having a plurality of closely spaced terminal receiving cavities. Included are insertion means for inserting a terminal into a selected cavity and positioning means for moving and positioning the holder so that a selected cavity is in approximate alignment with the insertion means. The apparatus permits limited further motion of the connector housing with respect to the insertion means. A guide means is provided for engaging the housing and moving it an amount within the range of the limited further motion to precisely align the selected cavity with the insertion means and for guiding a terminal being moved into the selected cavity during insertion. The guide means includes a guide member having a through hole arranged on an axis and sized to allow the terminal to pass therethrough. The hole extends from a first to a second surface of the guide member, wherein the hole at the first surface has dimensions substantially equal to or smaller than those of the selected cavity. The first surface includes features for engaging the housing and thereby effecting movement thereof in a direction to align the selected cavity with the through hole. A means is provided for moving the guide member in a direction toward the connector housing for effecting the engagement thereof by the features and in an opposite direction away from the connector housing.

DESCRIPTION OF THE PREFERRED EMBODIMENT

Figure 1:
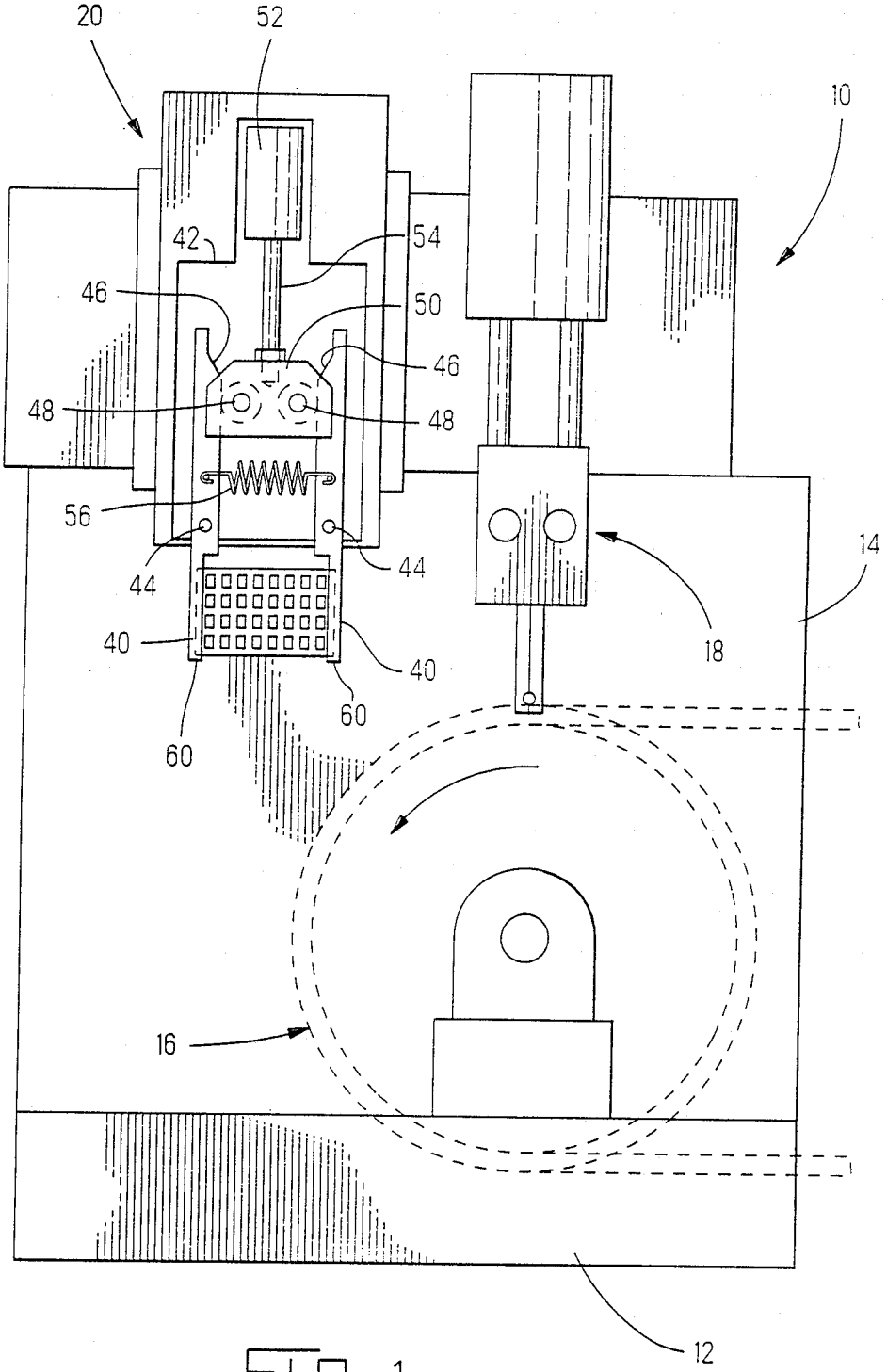
FIG. 1 is a schematic representation of a front view of a machine for making electrical cables.
Figure 2:
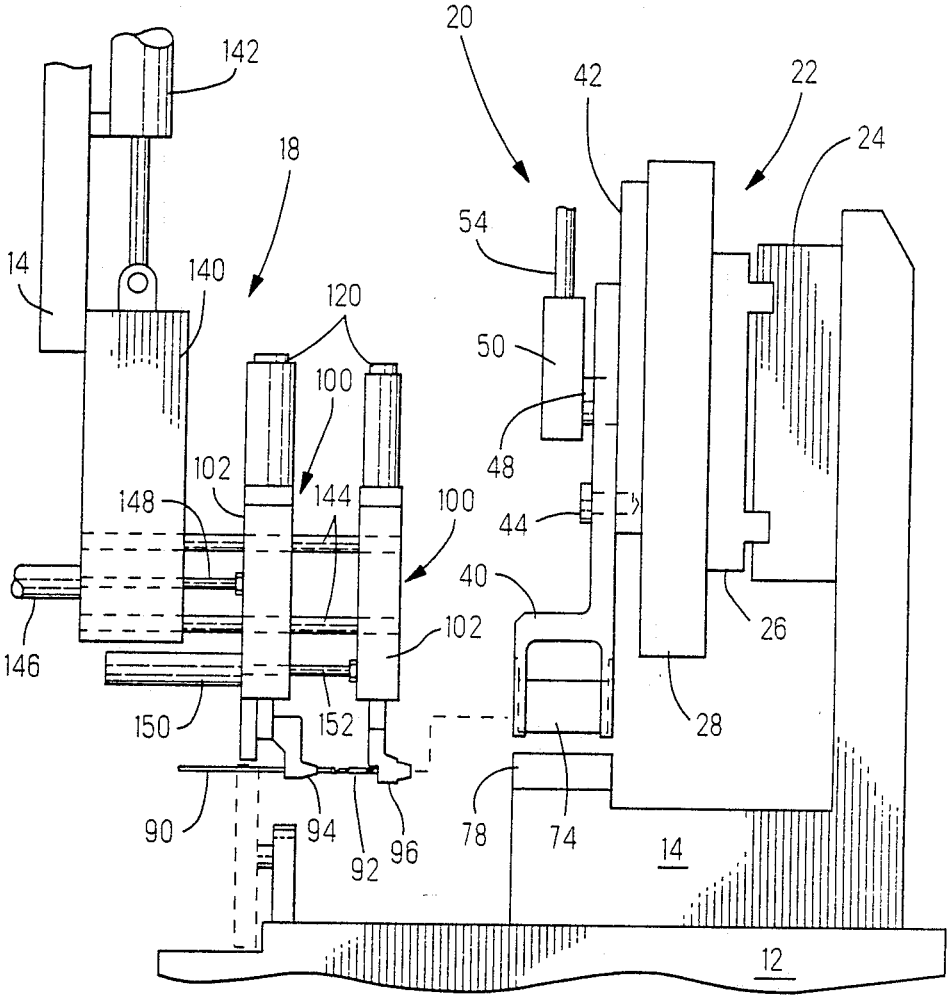
FIG. 2 is a right side view of the machine of FIG. 1.

There is shown in FIGS. 1 and 2 a schematic representation of a portion of an automated machine 10 for making electrical cables. The portion shown includes a base 12, a frame 14, a wire transfer mechanism 16, terminal insertion apparatus 18, and connector housing holding and positioning apparatus 20. The holding and positioning apparatus 20 includes an X-Y robotic table 22 comprising a base portion 24 rigidly secured to the frame 14 by any suitable means, a horizontal slide 26 which moves horizontally in the X direction and a vertical slide 28 which moves vertically in the Y direction. The X-Y table 22 is arranged to carry a connector housing holder comprising a pair of arms 40 which are pivotally attached to a back plate 42 at 44, the back plate being attached to the vertical slide 28 with any suitable screw fasteners, not shown. Each arm 40 includes a camming surface 46 and a follower 8 in engagement therewith. The two followers 48, which may rollers or stationary pins, are attached to a follower plate 50 which is arranged for vertical movement on the back plate 42 as viewed in FIG. 1. This may be accomplished by means of a key and keyway arrangement, not shown, or any such suitable means. A linear actuator 52, such as an air cylinder, is rigidly attached to the back plate 42 and has a piston rod 54, the end of which is attached to the follower plate 50 by means of a threaded hole in the usual manner. A coil tension spring 56 is arranged to urge the two arms 40 into cam following engagement with the followers 48 as best seen in FIG. 1. When the air cylinder 52 is pressurized to retract the piston rod 54, the follower plate 50 and followers 48 are drawn upwardly as viewed in FIG. 1 thereby allowing the arms 40, at their lower ends 60, to pivot away from each other about the pivot points 44 to an open position shown in FIG. 3. When the air cylinder is pressurized in the opposite direction to extend the piston rod 54, the follower plate 50 and followers 48 are moved downwardly thereby causing the ends 60 of the arms 40 to pivot toward each other to a closed position shown in FIGS. 1 and 4.

Figure 3:
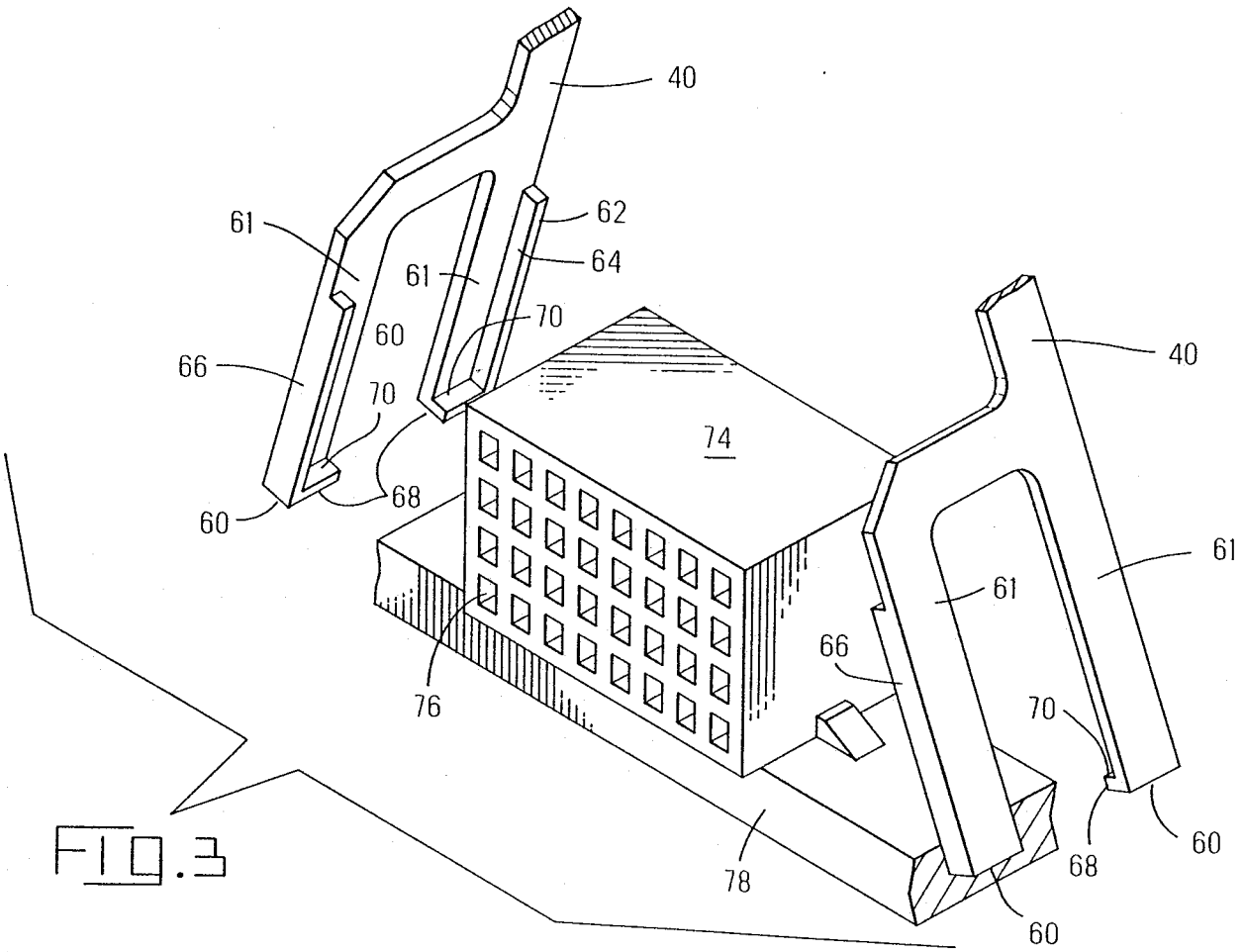
FIG. 3 is an isometric view of a holder about to grasp a connector housing.
Figure 4:
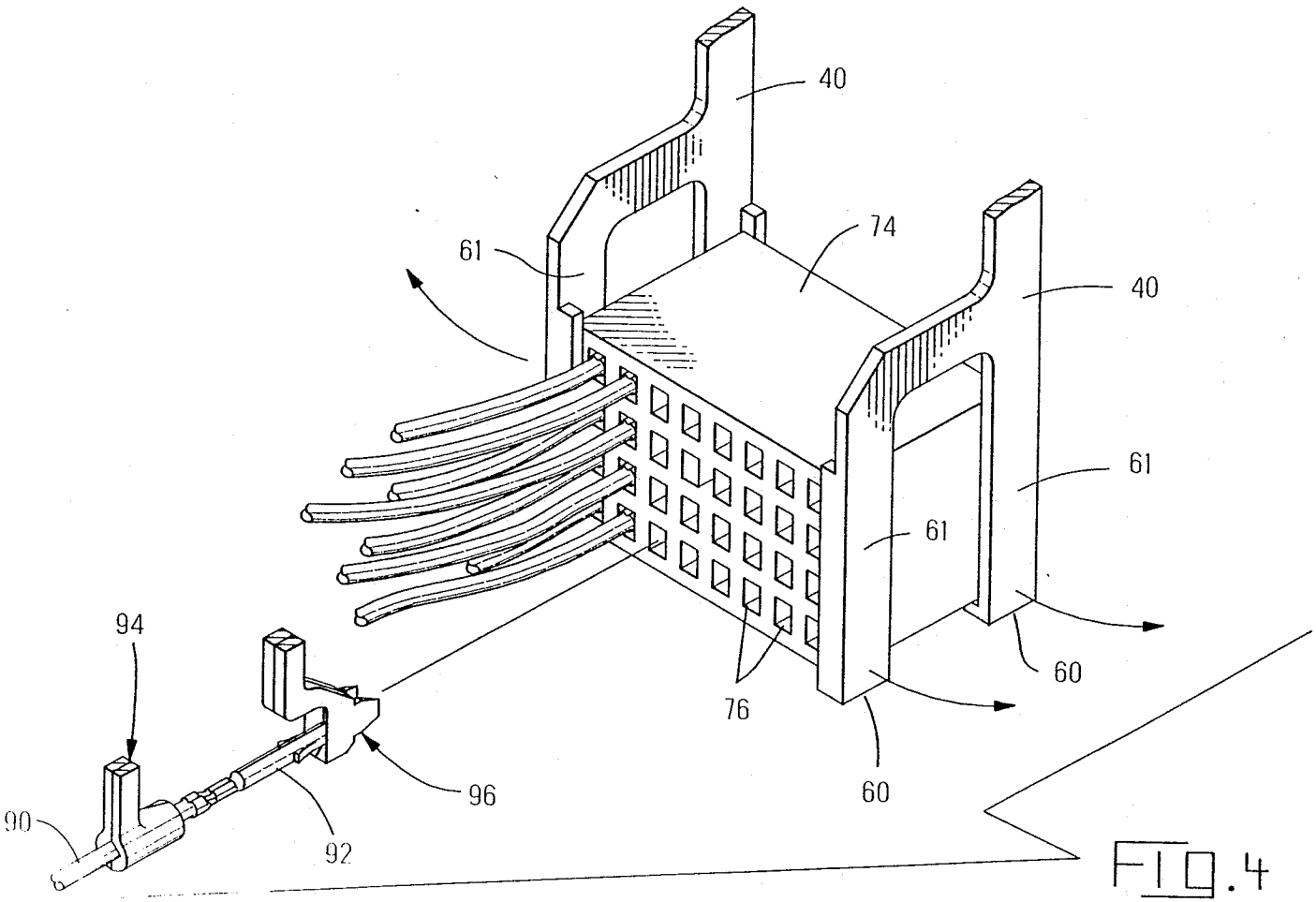
FIG. 4 is an isometric view showing the connector housing during the insertion of terminals and associated wires.
Figure 6:
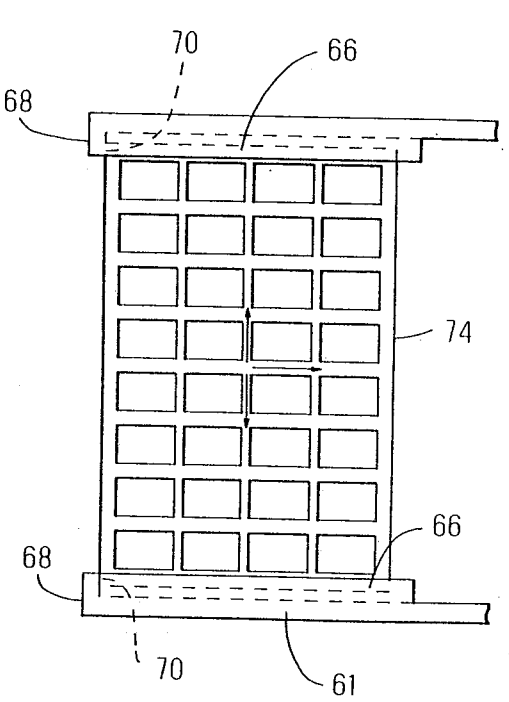
FIG. 6 is a front view of the connector housing and a portion of the holder taken along the lines 6—6 of FIG. 5.
Figure 5:
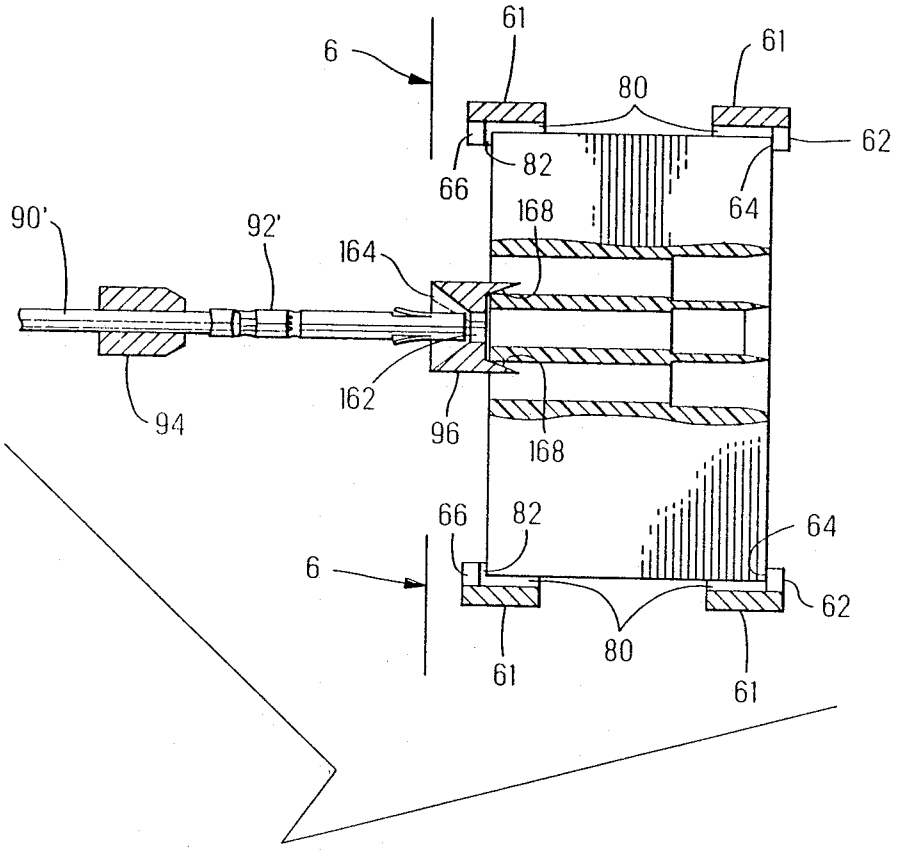
FIG. 5 is a cross-sectional view taken along the lines 5—5 of FIG. 7.

The arms 40, as best seen in FIGS. 3 and 4, each have a pair of parallel projections 61 which include rear side flanges 62 having rear walls 64, front flanges 66, and front and back bottom flanges 68 having floor surfaces 70. A typical connector housing 74 having a plurality of terminal receiving cavities 76 is shown in FIG. 3, on a conveyor 78. The conveyor 78 is mounted the frame 14 as best seen in FIG. 2 and is arranged to transport connector housings 74 from a supply area, not shown, to the connector housing holder and positioning apparatus 20 as seen in FIGS. 2 and 3. FIGS. 4, 5, and 6 show the connector housing 74 being held between the two arms 40 with the arms in their closed position Note that there is a small amount of clearance, about 0.015 inch, on each side of the housing 74 between the housing and the parallel projections 61 as indicated at 80 in FIG. 5. Additionally clearance is provided between the housing 74 and the front flanges 66 as indicated at 82. This clearance 82, some of which may be between the housing 74 and the rear wall 64, is necessary to enable the arms 40 to properly close and engage the housing 74 and should be sufficiently large to compensate for all tolerance variations in the connector housing 74 and machine 10. The clearance shown at 80 serves a very important purpose that will be explained in detail below. With the connector housing 74 held by the arms 40, the arms 40 being in their closed position as shown in FIG. 4, individual wires 90, each having a terminal 92 crimped thereto, may be inserted into appropriate cavities 76.

Figures 7, 8, 9, 10:
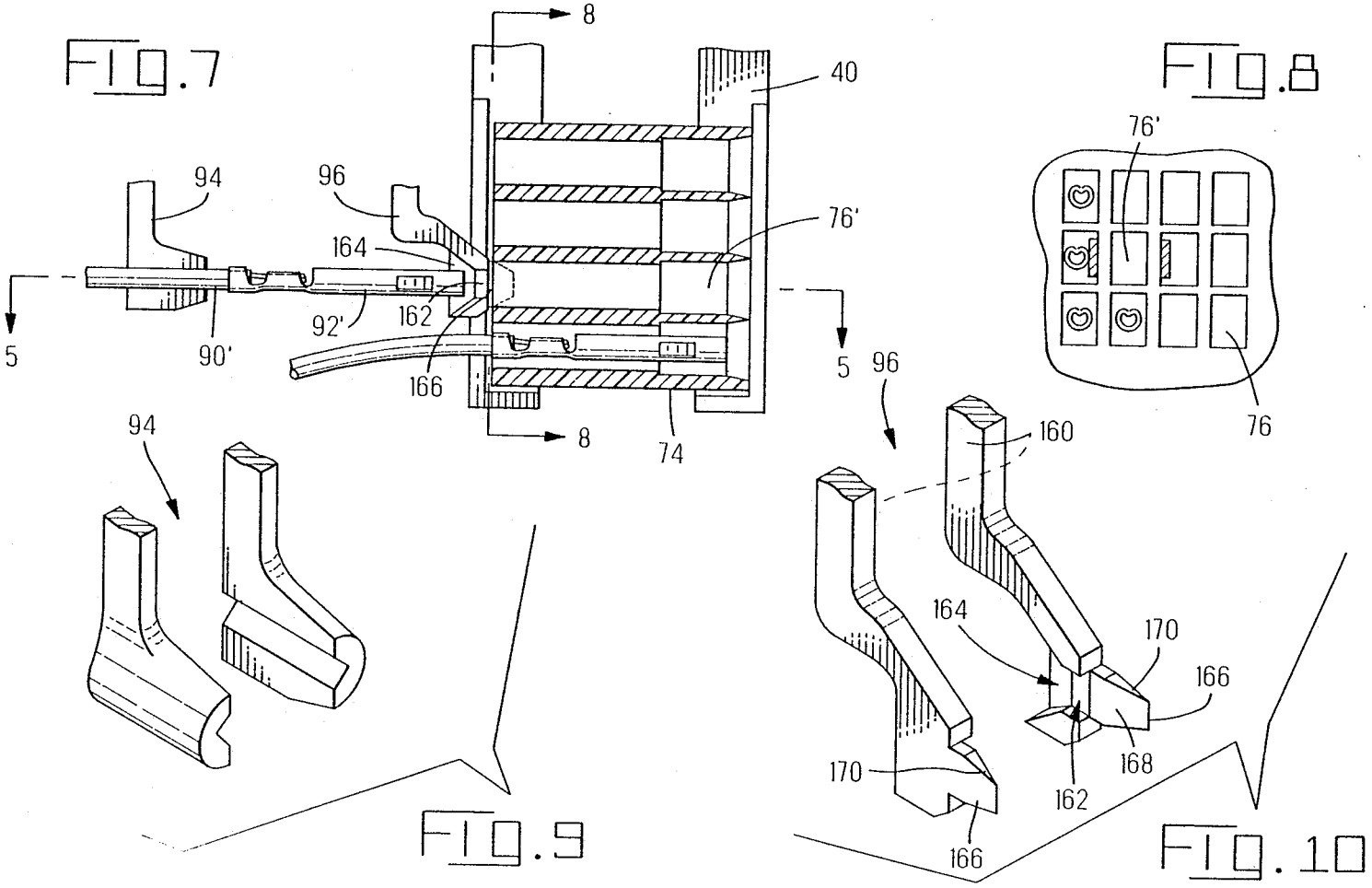
FIG. 7 is a partial cross-sectional view of the wire gripper, guide member, and the connector housing prior to insertion of a terminal.
FIG. 8 is a front view of a portion of the connector housing taken along the lines 8—8 of FIG. 7.
FIG. 9 is an isometric view of a portion of a typical wire gripper in its open position.
FIG. 10 is an isometric view of a portion of a guide member according to the teachings of the present invention.
Figure 11:
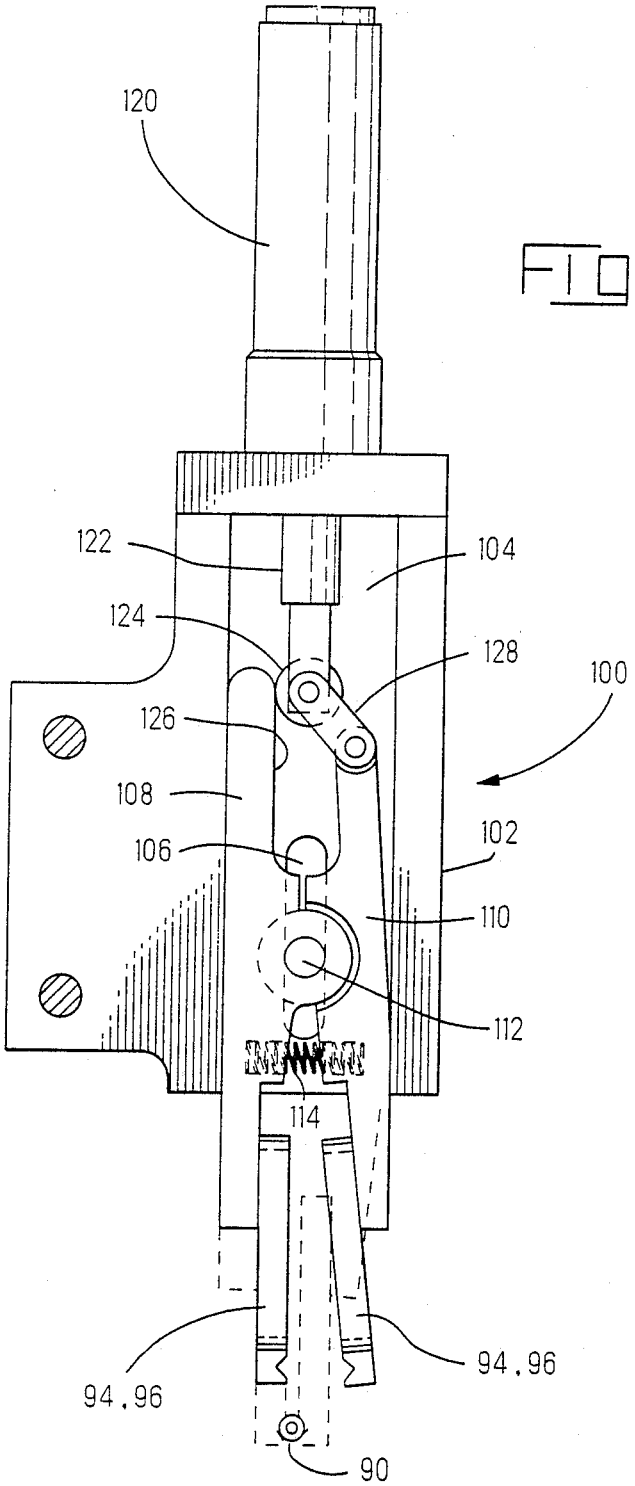
FIG. 11 is an end view of an actuating mechanism for the wire gripper and guide member of the present invention.

The insertion of the wires and terminals is accomplished by means of the terminal insertion apparatus 18 which includes a two part wire gripper 94 that operates in combination with a two part guide member 96. Portions of the two part gripper 94 and guide member 96 are shown in FIGS. 9 and 10 respectively and are arranged to be in either of two positions, an open position as shown in FIG. 9 and 10 and a closed position as shown in FIGS. 2 and 4. An actuating mechanism 100 to accomplish this movement is shown in FIG. 11. The mechanism 100 includes a frame 102 having a vertically disposed channel !04 and an elongated hole 106 formed through its rear wall. A pair of mutually pivotable members 108 and 110 are arranged to pivot about a pivot pin 112 which extends into the elongated hole 106 and is vertically guided therein. A compression spring 114 is arranged to urge the lower ends of the members 108 and 110 apart as shown in FIG. 11. The channel 104 and elongated hole 106 are sized to permit the pair of members 108 and 110 to slide vertically within the channel 104 without binding and without appreciable side play. An air cylinder 120 is secured to the top of the frame 102 and includes a piston rod 122 which extends into the channel 104 along its longitudinal axis. The piston rod 122 terminates in a roller 124 which engages a surface 126 of the member 108, and a toggle link 128 which is pivotally attached to the upper end of the member 110. The two part wire gripper 94 or the two part guide member 96 may be removably attached to the lower ends of the members 108,110, as shown in FIG. 11, by any suitable means such as screw fasteners, not shown. In operation the mechanism 100 is actuated by pressurizing the air cylinder 120 to cause the piston rod 122 to extend further into the channel 104. This causes the members 108 and 110, which are held apart at their lower ends by the spring 114, to slide downwardly within the channel 104, as viewed in FIG. 11. At the point where the pin 112 bottoms in the elongated hole 106, the gripper 94 or the guide member 96 should be straddling the wire 90 or terminal 92 respectively. Further extension of the piston rod 122 causes the roller 124 to track along the surface 126 so that the toggle link 128 urges the member 110 to pivot clockwise about the pin 112 thereby causing the gripper 94 or guide member 96 to close as shown in FIG. 4. It will be understood that the structure of the mechanism 100 described above is by way of example only and any structure suitable for opening and closing the two part wire gripper 94 and the two part guide member 96 may be utilized in the practice of the present invention.

The terminal insertion apparatus 18, as seen in FIG. 2, also includes a vertically movable base 140 which is moved by any suitable linear actuator such as an air cylinder 142, to move the wire gripper 94 and guide member 96 from a position for receiving the wire 90 and terminal 92, a shown in FIG. 2 to a position for inserting the wire and terminal into the connector housing 74 as shown in FIGS. 4 and 7. The base 140 has a pair of rods 144 projecting therefrom in cantilever fashion which engage a pair of linear bearings in each of the frames 102 so that the two actuating mechanisms 100 can transverse the rods 144 in a direction generally parallel to the axis of the wire 90. An air cylinder 146 is secured to the base 140 and is arranged so that its piston rod 148 extends through a clearance opening in the base 140 and attaches to the left most frame 102. Similarly, an air cylinder 150 is secured to the left most frame 102 and is arranged so that its piston rod 152 extends through a clearance opening in that frame and attaches to the right most frame 102, as seen in FIG. 2. With the air cylinder 150 pressurized to extend the piston 152, both of the mechanisms 100 can be caused to move in a direction generally toward and away from the connector housing holding and positioning apparatus 20, as will be explained below.

FIGS. 5 and 7 show cross-sectional views of the connector housing 74 with the guide member 96 and wire gripper 94 in position to insert a terminal 92' and attached wire 90' into the cavity 76'. Note that a portion of the two part gripper 94 and of the two part guide member are omitted from FIG. 7 for clarity. As can be seen in FIGS. 7 and 10, each part of the two part guide member 96 are mirror images of each other intended to be used when their mating surfaces 160 are abuttingly engaged, their closed position, as shown in FIGS. 2 and 4. When in the closed position, the guide member 96 includes a through hole 162 having a similar shape and sized either equal to or slightly smaller than the cavity 76, see FIGS. 5, 7 and 10. The hole 162 diverges into a somewhat funnel shaped opening 164 toward the wire gripper 94 to serve as a lead-in as the terminal 92' is moved into the hole 162 during insertion. A pair of guide fingers 166, one on each part of the guide member 96, project outwardly in the direction toward the connector housing 74 as shown in FIGS. 7 and 10. The guide fingers 166 have inner surfaces 168 that mutually diverge, as best seen in FIG. 5, and upper and lower surfaces 170 which converge, as best seen in FIGS. 7 and 10.

In operation, these surfaces 168 and 170 serve to engage the connector housing 74, as the guide member 96 approaches, and enters two cavities, one on either side of the selected cavity 76'. As entry continues the surface 170 will cam the connector housing 74 upwardly if needed so that the selected cavity 76' is in alignment with the hole 166 in the vertical direction, and the surfaces 168 will cam the housing 74 so that the cavity 76' is in alignment in the horizontal direction.

By way of background, the distance between two end cavities 76 of a 12 cavity row plastic connector housing can vary by plus or minus 0.004 inch due to shrinkage and molding tolerances. Additionally, positioning inaccuracies in the terminal insertion apparatus 18 and the connector housing holding and positioning apparatus 20 due to machine part tolerances and clearances can amount to another 0.001 inch for a total possible mismatch in horizontal alignment of a given cavity 76' of plus or minus 0.005 inch. This mismatch is more than sufficient to prevent insertion of a terminal 92 into the selected cavity 76'. As mentioned above, the clearance space 80, shown in FIG. 5, between the connector housing 74 and the parallel projections 61, is about 0.015 inch on each side. This means that the predictable position of the selected cavity 76' relative to the arms 40 of the connector housing holder is within plus or minus 0.020 inch. Therefore, the surfaces 168 must be sufficiently angled from the longitudinal axis of the cavity 76' to engage the walls of the two adjacent cavities and cam the connector housing 74 either left or right for a maximum distance of 0.020 inch. Similarly, the surface 170 must be arranged to cam the connector housing 74 upwardly for a maximum distance of 0.020 inch.

During operation of the machine 10, the cylinder 52 is activated to open the arms 40, as shown in FIG. 3, and the connector housing holder is moved to pick-up position over the conveyor 78. The positioning apparatus 20 then moves the arms 40 downwardly, the air cylinder 52 closes the arms 40 about the housing 74, and the apparatus 20 moves the housing 74 so that the first cavity in insertion position opposite the terminal insertion apparatus 18, is shown in FIG. 2. The two cylinders 120 of the insertion apparatus 18 are activated to open the two part gripper 94 and the two part guide member 96 to the positions shown in FIGS. 9 and 10. Additionally, the two cylinders 146 and 150 are activated to properly position the gripper 94 and wire guide 96 as shown in FIG. 2, the cylinder 150 receiving a relative lower pressure. The gripper 94 and guide member 96 are then lowered to the position shown in FIG. 2, closed on the wire 90 and terminal 92, and then raised so that the opening 162 in the guide member 96 is in approximate alignment with the selected first cavity 76. The cylinder 146 is then pressurized by a relatively higher pressure than is the cylinder 150 to move the two mechanisms 100 along the rods 144 in a direction toward the connector housing 74. As this movement continues, the surfaces 168 and 170 of the guide member 96 engage the connector housing 74 and enter the two adjacent cavities on either side of the selected cavity 76' thereby camming the connector housing 74 so that the cavity 76' is in substantial alignment with the opening 162. As the piston rod 148 continues to extend from the cylinder 146, the guide member 96 comes to rest against the housing 74 and the gripper 94, wire 90, and terminal 92 continue to move toward the housing 74, overcoming the low pressure of the cylinder 150 thereby allowing the piston rod 152 to recede back into its cylinder. This motion continues until the terminal 92' is fully inserted and seated in the selected cavity 76'. The cylinder 146 is then reverse-pressurized to pull test the just inserted wire and terminal, the wire gripper 94 and guide member 96 are opened, and the terminal insertion apparatus 18 is withdrawn and repositioned to receive another wire to be inserted and the process repeated until all desired wires terminals are inserted.

Figure 12:
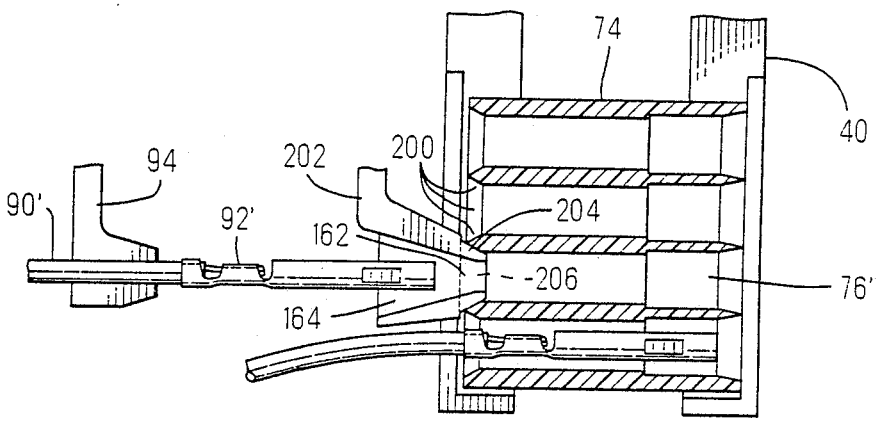
FIGS. 12 and 13 are views similar to that of FIG. 7 showing second and third embodiments of the present invention.

A second embodiment of the guide member is shown in FIG. 12, for use where the cavities 76 of the connector housing 74 include countersinks 200 at the insertion end of the cavity. There is shown in FIG. 12 a two part guide member 202 with a portion of one of the parts omitted for clarity in a manner similar to that shown in FIG. 7. The guide member 202 is similar to the guide member 96 except that instead of having surfaces 168 and 170 that engage the cavities on either side of the selected cavity, it has sloping surfaces 204 and 206 which match and engage the surfaces of the countersink 200 of the selected cavity 76'. During such engagement the surfaces 204 and 206 cam the housing 74 both upwardly and horizontally, as needed, to align the selected cavity 76' with the opening 162. In all other respects the guide member 202 functions in a manner similar to that of the guide member 96.

Figure 13:
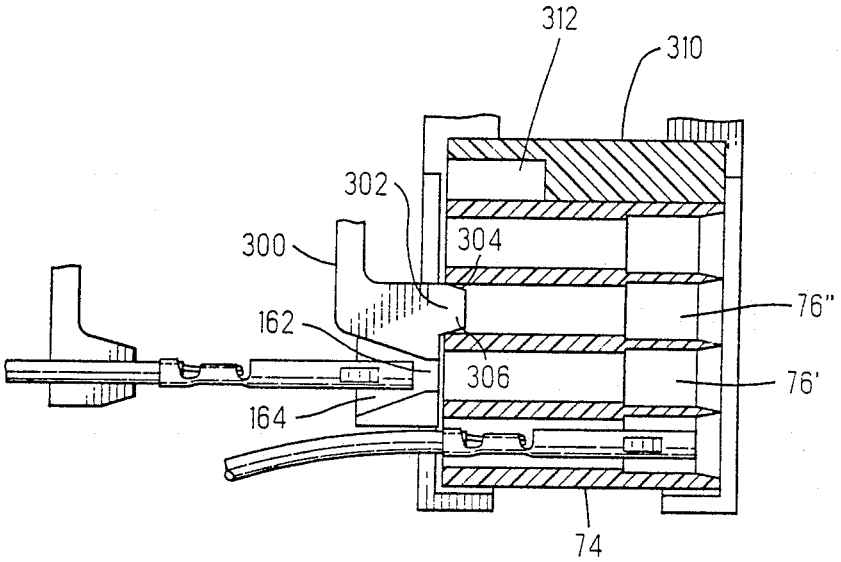

A third embodiment of the guide member is shown in FIG. 13 and is identified as 300. As with FIGS. 7 and 12, a portion of one of the parts of the two part guide member 300 is omitted. The guide member 300 is similar to the guide members 96 and 202 except that a projection 302 having substantially the same shape as a cavity 76 but slightly smaller is used to engage a cavity 76'' that is adjacent the selected cavity 76''. The projection 302 includes sloping surfaces 304 and 306 which, during engagement cam the connector housing 74 upwardly and horizontally, as needed, to align the selected cavity 76' with the opening 162. This embodiment requires an auxiliary member 310 having a row of cavities 312 which correspond in size, shape, and spacing to the cavities 76 in the top row of the housing 74. The member 310 is positioned adjacent the housing 74 so that the cavities 312 are in substantial alignment with the cavities 76 in the top row. The projection 302 then can engage the cavities 312 for aligning the top row of cavities 76 during insertion. The member 310 may be spring loaded against the top of the housing 74 and may be part of the connector housing holder and positioned by any suitable means.

An important advantage of the present invention is that the guide member having cavity engaging features such as the surfaces 168, 170, 204, 206, 304 and 306 can align a selected cavity very closely with a funnel shaped opening for insertion of a terminal and wire without danger of stubbing the terminal on an edge of the connector housing. Further, this alignment is accomplished even though substantial tolerance variations in the plastic connector housing are present.

I claim:

1. In a block loader apparatus for an electrical cable making machine including a holder means for holding a connector housing having a plurality of closely spaced terminal receiving cavities, insertion means for inserting a terminal into a selected cavity, and positioning means for moving and positioning said holder so that said selected cavity is in approximate alignment with said insertion means, said apparatus permitting limited further motion of said connector housing with respect to said insertion means, guide means for engaging said housing and moving it an amount within the range of said limited further motion to precisely align said selected cavity with said insertion means and for guiding a terminal being moved into said selected cavity during said inserting comprising:

(a) a guide member having a through hole arranged on an axis and sized to allow a terminal to pass therethrough, said hole extending from a first surface to a second surface of said guide member, said hole at said first surface having dimensions substantially equal to or smaller than those of said selected cavity, said first surface including features for said engaging said housing and thereby effecting said moving thereof in a direction to align said selected cavity with said through hole; and (b) means for moving said guide member in a direction toward said connector housing for effecting said engagement thereof by said features and in an opposite direction away from said connector housing.

2. The apparatus according to claim 1 wherein said features of said guide member include a projection that extends from said first surface outwardly toward said connector housing so that as said means for moving said guide member effects said engagement with said connector housing said projection engages at least one of said cavities and thereby cams said housing in said direction to align said selected cavity with said hole.

3. The apparatus according to claim 2 wherein said pair of projections each include angled surfaces for camming said housing in substantially all directions on a plane substantially normal to said axis of said hole.

4. The apparatus according to claim 3 wherein said hole has a dimension at said second surface substantially larger than at said first surface.

5. The apparatus according to claim 4 wherein said projection engages a cavity adjacent said selected cavity.

6. The apparatus according to claim 5 wherein said projection comprises a pair of projections each of which engages cavities on opposite sides of and adjacent said selected cavity.

7. The apparatus according to claim 4 wherein said projection engages only one cavity adjacent said selected cavity.

8. The apparatus according to claim 4 wherein said projection engages only said selected cavity.

9. The apparatus according to claim 1 wherein said guide member comprises a first half and a second half having opposed mating surfaces each containing a radial portion of said hole, said guide member arranged to be in either an open position where said first half is sufficiently spaced from said second half to permit said guide member to withdraw from said wire in a direction lateral to said axis, or a closed position where said first and second halves are in contact along portions of said opposed mating surfaces.

10. The apparatus according to claim 9 wherein said hole is a substantially funnel shaped continuous internal surface, when said guide member is in said closed position, for guiding a terminal through said guide member and into said selected cavity.

* * * * *